US008047376B1

(12) United States Patent
Kuo

(10) Patent No.: US 8,047,376 B1
(45) Date of Patent: Nov. 1, 2011

(54) PAPER CUSHIONING STRUCTURE

(76) Inventor: Sheng-Hsi Kuo, Hsinchu (TW)

( * ) Notice: Subject to any disclaimer, the term of this patent is extended or adjusted under 35 U.S.C. 154(b) by 0 days.

(21) Appl. No.: 12/828,317

(22) Filed: Jul. 1, 2010

(51) Int. Cl.
*B65D 81/02* (2006.01)
*B65D 25/04* (2006.01)
*B65D 5/00* (2006.01)

(52) U.S. Cl. ..... 206/588; 229/120.32; 229/121; 229/122

(58) Field of Classification Search ..... 206/521, 206/583, 587, 588, 592; 229/120.32, 120.37, 229/120.38, 121, 122, 122.26
See application file for complete search history.

(56) References Cited

U.S. PATENT DOCUMENTS

| | | | | | |
|---|---|---|---|---|---|
| 3,050,228 | A * | 8/1962 | Lane | 229/120.32 |
| 3,272,328 | A * | 9/1966 | Krzyzanowski | 229/120.32 |
| 4,282,999 | A * | 8/1981 | Moen | 229/120.38 |
| 4,753,349 | A * | 6/1988 | Monek | 206/592 |
| 4,976,374 | A * | 12/1990 | Macaluso | 229/122.26 |
| 6,006,917 | A * | 12/1999 | Loeffler | 206/583 |
| 2010/0258474 | A1 * | 10/2010 | Liu | 206/587 |

* cited by examiner

*Primary Examiner* — Bryon Gehman

(57) ABSTRACT

One embodiment of a paper cushioning structure includes a corrugated, hollow support member of H cross-section having two open ends, the support member comprising a hollow, intermediate plate interconnecting both hollow sides; and two fixing members shaped to securely assemble at both ends of the support member respectively so as to form a packing space defined by the fixing members, the intermediate plate, and upper portions of the sides of the support member.

2 Claims, 18 Drawing Sheets

PAPER CUSHIONING STRUCTURE

BACKGROUND OF THE INVENTION

1. Field of Invention

The invention relates to cushioning materials and more particularly to a paper-based cushioning structure with improved characteristics.

2. Description of Related Art

Package cushioning is inside a shipping container. It is known that the high price articles (e.g., laptop computers) are required to be fully protected during transport.

Various type and styles of paper cushions are commercially available. Paper cushions are more environmentally friendly. However, conventional paper cushions do not provide sufficient resiliency or offer complete protection to articles packaged in a paper container. Thus, the need for improvement still exists.

SUMMARY OF THE INVENTION

It is therefore one object of the invention to provide a paper cushioning structure comprising an elongated, corrugated, hollow support member of H cross-section having two open ends, the support member comprising a hollow, intermediate plate interconnecting both hollow sides; and two fixing members shaped to securely assemble at both ends of the support member respectively so as to form a packing space defined by the fixing members, the intermediate plate, and upper portions of the sides of the support member.

The above and other objects, features, and advantages of the invention will become apparent from the following detailed description taken with the accompanying drawings.

DETAILED DESCRIPTION OF THE INVENTION

Figure 1:
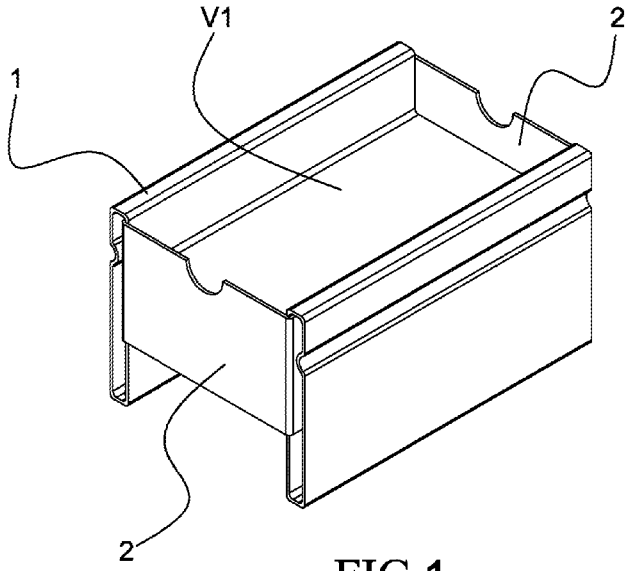
FIG. 1 is a perspective view of a first preferred embodiment of paper cushion according to the invention.
Figure 2:
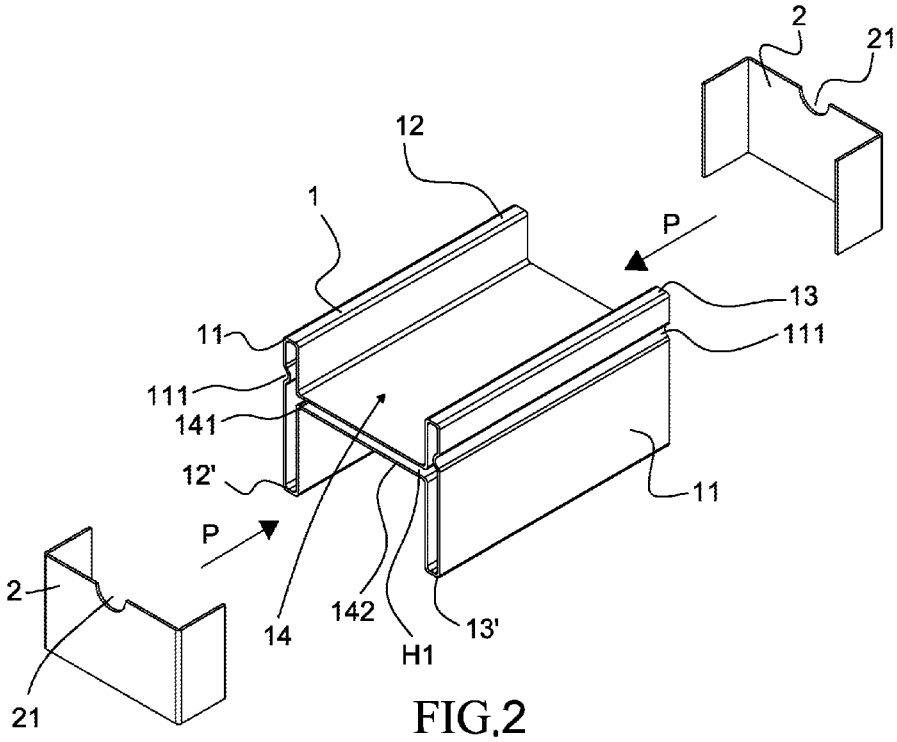
FIG. 2 is an exploded view of the paper cushion in FIG. 1.
Figure 3:
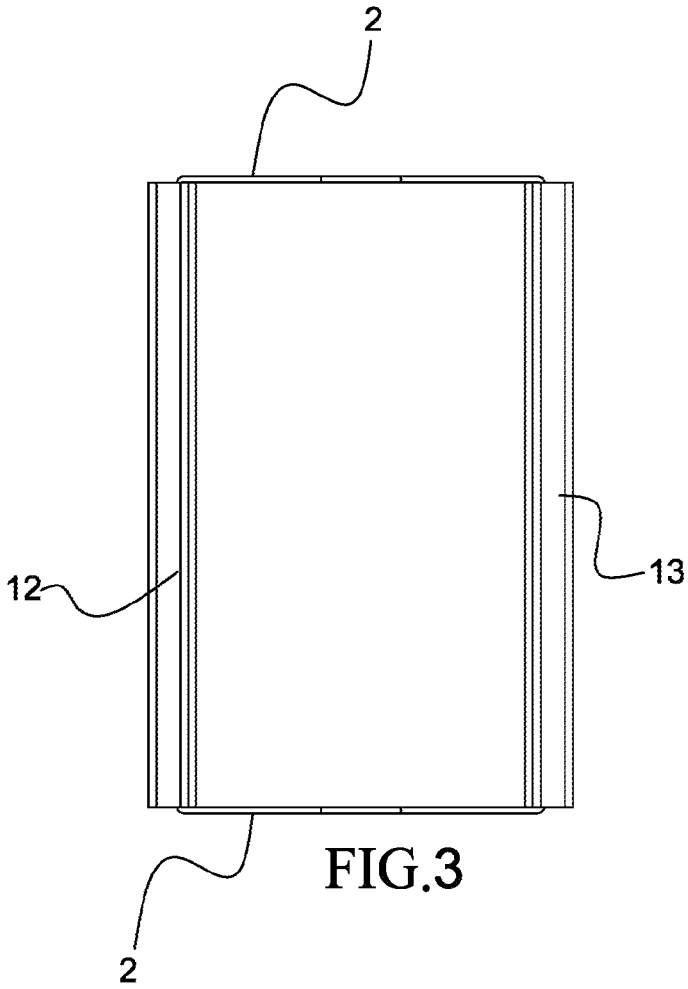
FIG. 3 is a top plan view of the paper cushion in FIG. 1.
Figure 4:
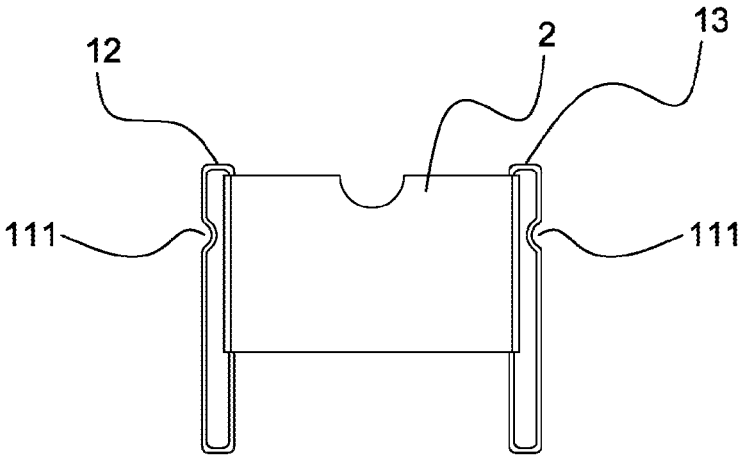
FIG. 4 is a front view of the paper cushion in FIG. 1.
Figure 5:
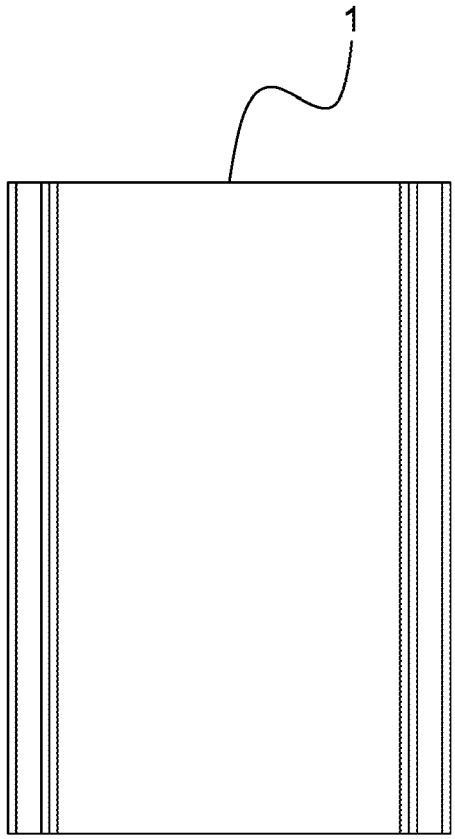
FIG. 5 is a top plan view of the support member in FIG. 2.
Figure 6:
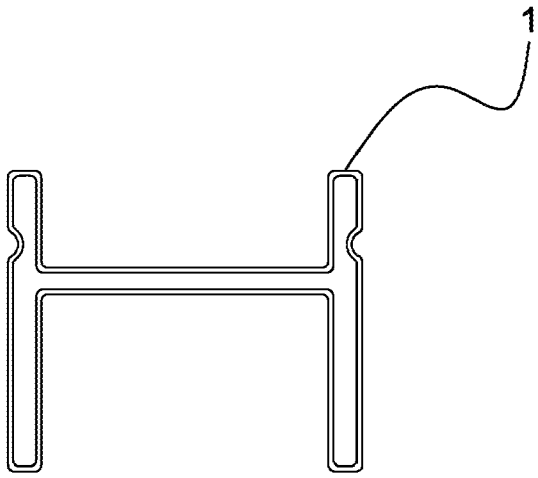
FIG. 6 is a front view of the support member in FIG. 2.

Referring to FIGS. 1 to 6, a paper cushion in accordance with a first preferred embodiment of the invention comprises the following components as discussed in detail below.

An elongated, hollow support member 1 of H cross-section has two opposite open ends and comprises two hollow rectangular side walls 11 each comprising a lengthwise elongated trough 111 terminating at both ends. One side wall 11 further comprises a flat top surface 12 and a flat bottom surface 12' and the other side wall 11 further comprises a flat top surface 13 and a flat bottom surface 13'. The support member 1 further comprises a hollow, rectangular intermediate plate 14 interconnecting both side walls 11. The intermediate plate 14 has a flat top surface 141, a flat bottom surface 142, and a hollow H1 between the top and bottom surfaces 141 and 142. The intermediate plate 14 has an elevation slightly less than that of the trough 111.

Each of two fixing members 2 has a rectangular end surface and two 90-degree bent rectangular sides. The fixing member 2 comprises a top recess 21. Length of the side wall 11 is more than twice of that of the side of the fixing member 2.

In assembly, both sides of each fixing member 2 are inserted into the hollows of the side walls 11 as indicated by arrows P to frictionally secure to either end of the support member 1. The tops of the sides of the fixing member 2 are slightly below the top surface 12 or 13. As a result, a paper cushion is assembled and has a packing space V1 having an open top. The packing space V1 is defined by the fixing members 2, the intermediate plate 14, and upper portions of the side walls 11. An article thus can be packed in the packing space V1 for transport.

Figure 7:
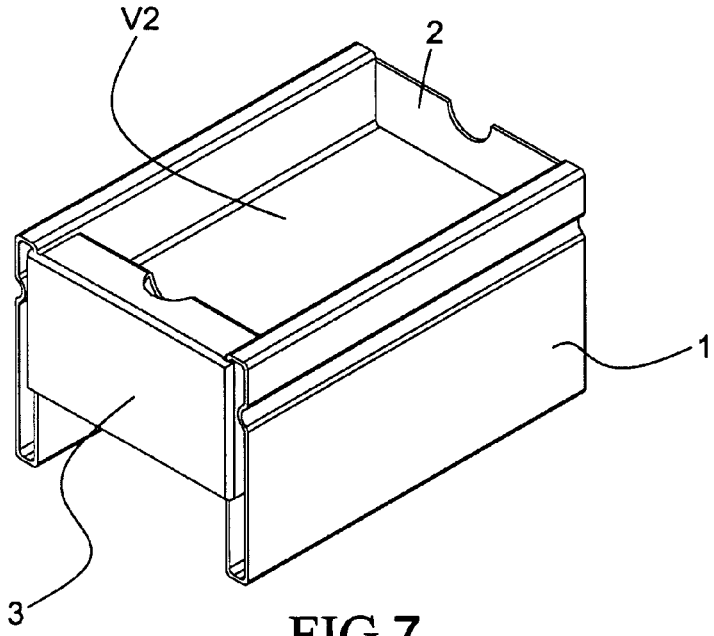
FIG. 7 is a perspective view of a second preferred embodiment of paper cushion according to the invention.
Figure 8:
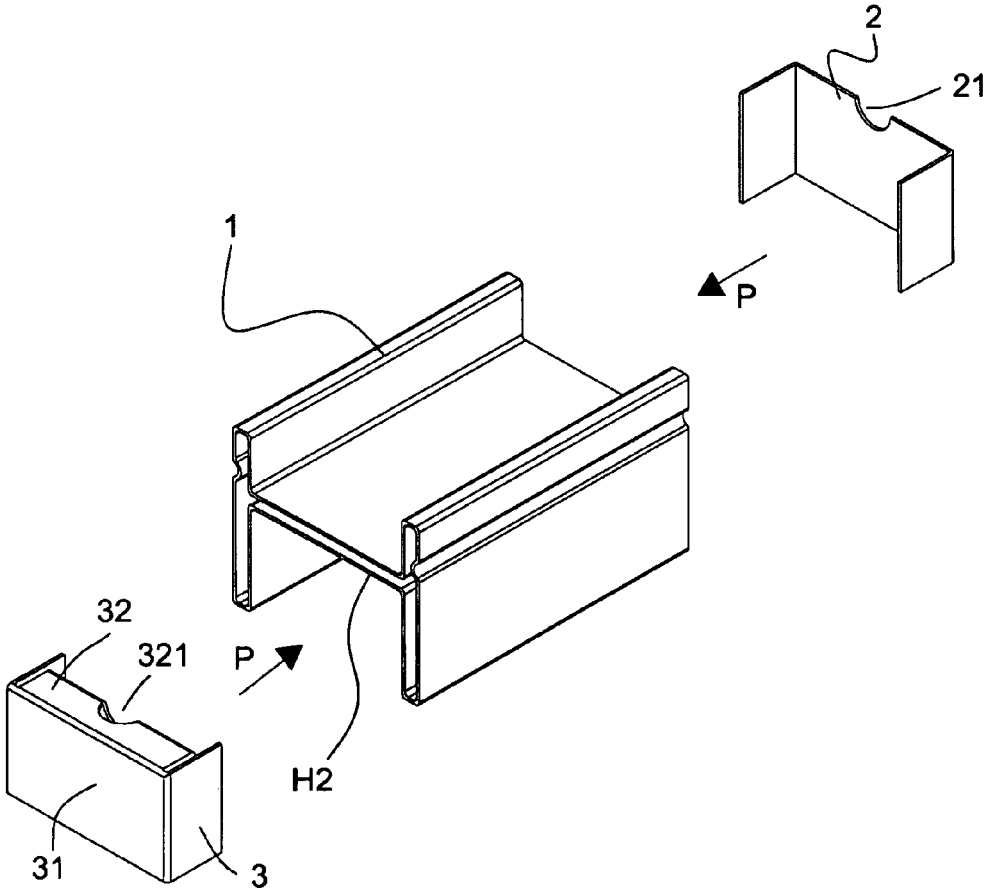
FIG. 8 is an exploded view of the paper cushion in FIG. 7.
Figure 9:
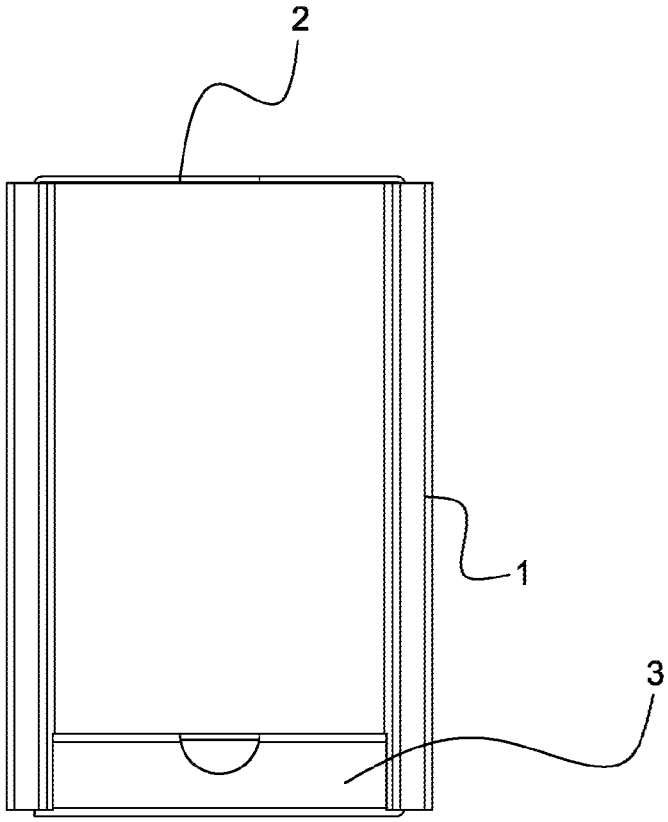
FIG. 9 is a top plan view of the paper cushion in FIG. 7.
Figure 10:
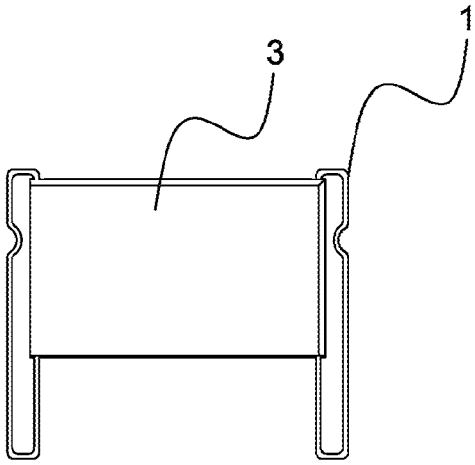
FIG. 10 is a front view of the paper cushion in FIG. 7.
Figure 11:
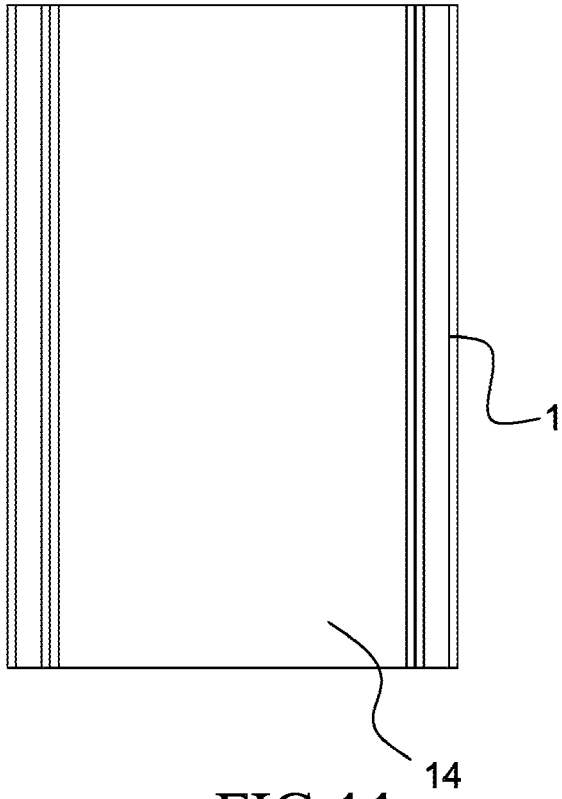
FIG. 11 is a top plan view of the support member in FIG. 8.
Figure 12:
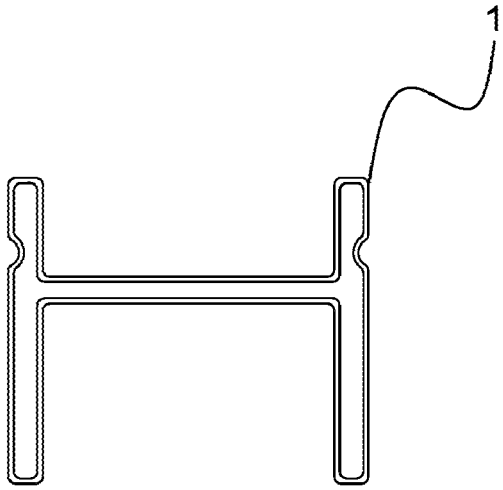
FIG. 12 is a front view of the support member in FIG. 8.

Referring to FIGS. 7 to 12, a paper cushion in accordance with a second preferred embodiment of the invention comprises the following components as discussed in detail below.

An elongated, hollow support member 1 of H cross-section has two opposite open ends and comprises two hollow rectangular side walls 11 each comprising a lengthwise elongated trough 111 terminating at both ends. One side wall 11 further comprises a flat top surface 12 and a flat bottom surface 12' and the other side wall 11 further comprises a flat top surface 13 and a flat bottom surface 13'. The support member 1 further comprises a hollow, rectangular intermediate plate 14 interconnecting both side walls 11. The intermediate plate 14 has a flat top surface 141, a flat bottom surface 142, and a hollow H2 between the top and bottom surfaces 141 and 142. The intermediate plate 14 has an elevation slightly less than that of the trough 111.

A first fixing member 2 has a rectangular end surface and two 90-degree bent rectangular sides. The first fixing member 2 comprises a top recess 21.

A second fixing member 3 has a rectangular end surface 31 and two 90-degree bent rectangular sides. The second fixing member 3 comprises an inverted L-shaped brace plate 32 extending inward from about top edge of the end surface 31. Either side of the brace plate 32 is spaced from either side of the second fixing member 3 by a distance substantially the same as the thickness of the inner surface of the upper portion of the side wall 11. Top of the brace plate 32 is disposed slightly below top of the second fixing member 3. A recess 321 is formed on a bending edge of the brace plate 32 distal the end surface 31. Length of the side wall 11 is more than addition of the sides of the first and second fixing members 2, 3.

In assembly, both sides of the first fixing member 2 are inserted into the hollows of the side walls 11 from one end as indicated by one arrow P and both sides of the second fixing member 3 are inserted into the hollows of the side walls 11 from the other end as indicated by the other arrow P to frictionally secure to both ends of the support member 1. The inner surface of the upper portion of the side wall 11 is inserted into the gap between the brace plate 32 and either side of the second fixing member 3 and fastened together. The bottom edge of the brace plate 32 is rested upon the intermediate plate 14. The tops of the sides of each of the first fixing member 2 and the second fixing member 3 are slightly below the top surface of the side wall 11. As a result, a paper cushion is assembled and has a packing space V2 having an open top. The packing space V2 is defined by the first and second fixing members 2 and 3, the intermediate plate 14, and upper portions of the side walls 11. An article thus can be packed in the packing space V2 for transport.

Figure 13:
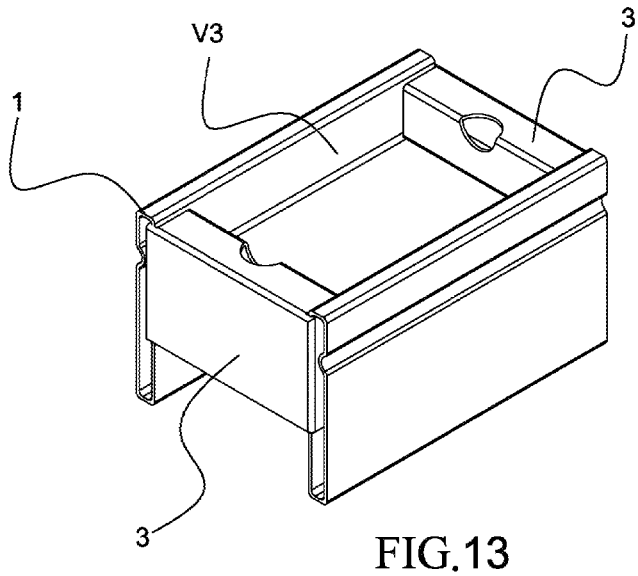
FIG. 13 is a perspective view of a third preferred embodiment of paper cushion according to the invention.
Figure 14:
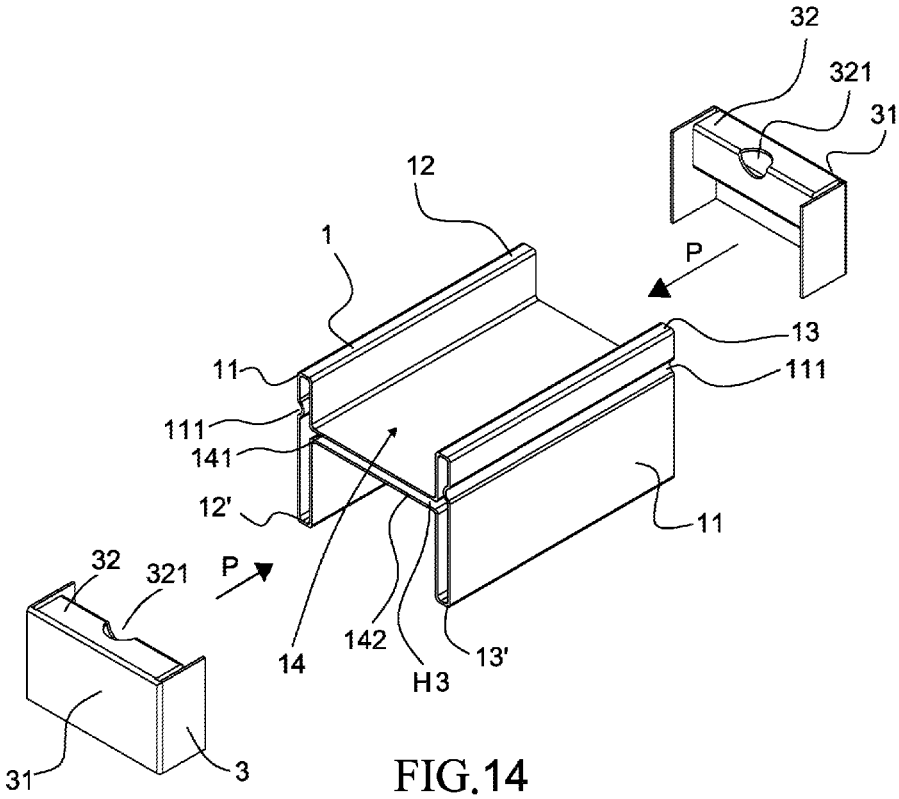
FIG. 14 is an exploded view of the paper cushion in FIG. 13.
Figure 15:
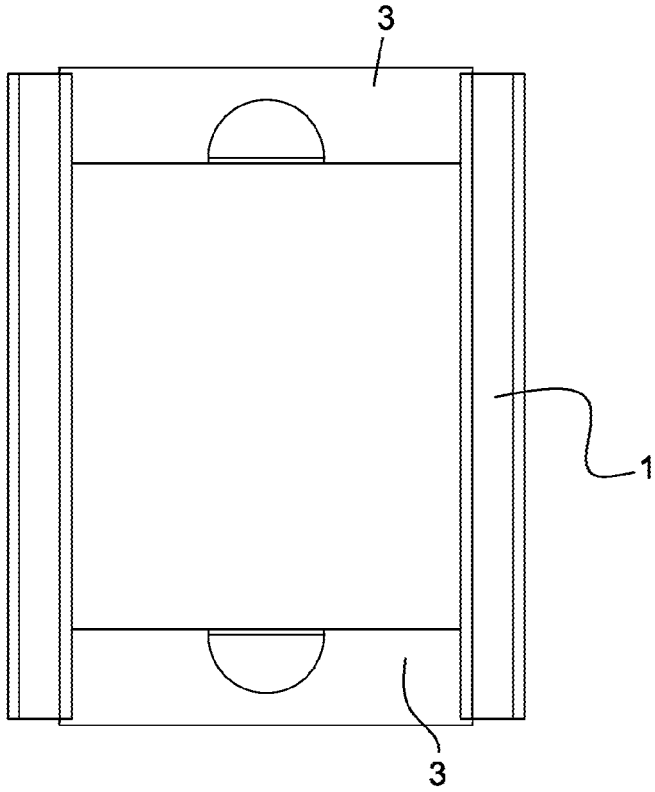
FIG. 15 is a top plan view of the paper cushion in FIG. 13.
Figure 16:
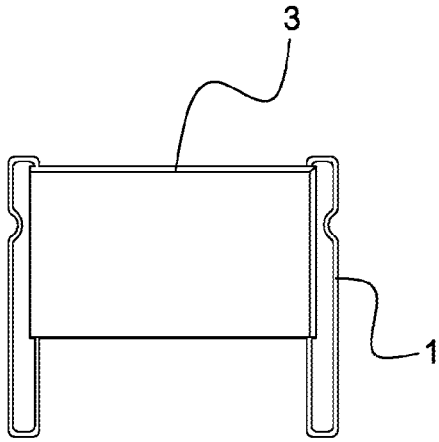
FIG. 16 is a front view of the paper cushion in FIG. 13.
Figure 17:
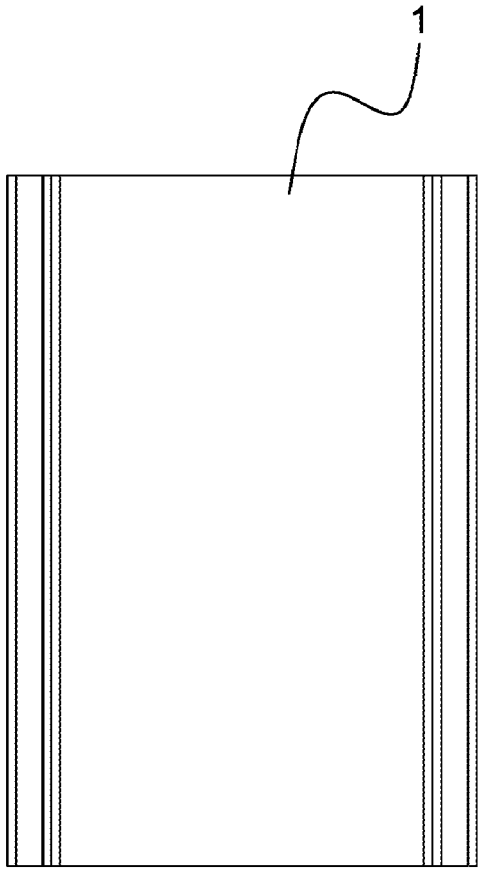
FIG. 17 is a top plan view of the support member in FIG. 14.
Figure 18:
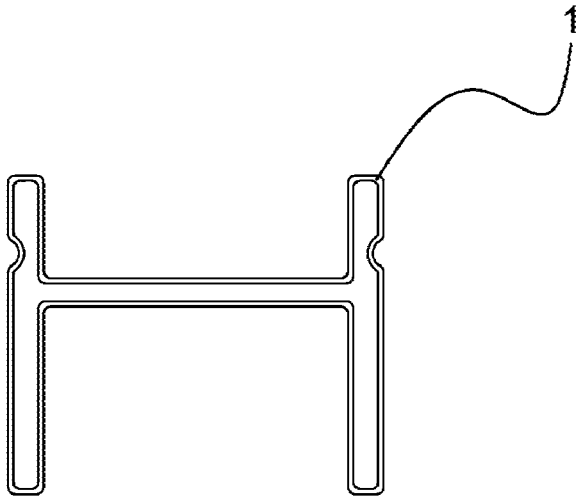
FIG. 18 is a front view of the support member in FIG. 14.

Referring to FIGS. 13 to 18, a paper cushion in accordance with a third preferred embodiment of the invention comprises the following components as discussed in detail below.

An elongated, hollow support member 1 of H cross-section has two opposite open ends and comprises two hollow rectangular side walls 11 each comprising a lengthwise elongated trough 111 terminating at both ends. One side wall 11 further comprises a flat top surface 12 and a flat bottom surface 12' and the other side wall 11 further comprises a flat top surface 13 and a flat bottom surface 13'. The support member 1 further comprises a hollow, rectangular intermediate plate 14 interconnecting both side walls 11. The intermediate plate 14 has a flat top surface 141, a flat bottom surface 142, and a hollow H3 between the top and bottom surfaces 141 and 142. The intermediate plate 14 has an elevation slightly less than that of the trough 111.

Each of two fixing members 3 has a rectangular end surface 31 and two 90-degree bent rectangular sides. The fixing member 3 comprises an inverted L-shaped brace plate 32 extending inward from about top edge of the end surface 31. Either side of the brace plate 32 is spaced from either side of the fixing member 3 by a distance substantially the same as the thickness of the inner surface of the upper portion of the side wall 11. Top of the brace plate 32 is disposed slightly below top of the fixing member 3. A recess 321 is formed on a bending edge of the brace plate 32 distal the end surface 31. Length of the side wall 11 is more than twice of that of the side of the fixing member 3.

In assembly, both sides of each fixing member 3 are inserted into the hollows of the side walls 11 from either end as indicated by arrows P to frictionally secure to both ends of the support member 1. The inner surface of the upper portion of the side wall 11 is inserted into the gap between the brace plate 32 and either side of the fixing member 3 and fastened together. The bottom edge of the brace plate 32 is rested upon the intermediate plate 14. The tops of the sides of each fixing member 3 are slightly below the top surface of the side wall 11. As a result, a paper cushion is assembled and has a packing space V3 having an open top. The packing space V3 is defined by the fixing members 3, the intermediate plate 14, and upper portions of the side walls 11. An article thus can be packed in the packing space V3 for transport.

Figure 19:
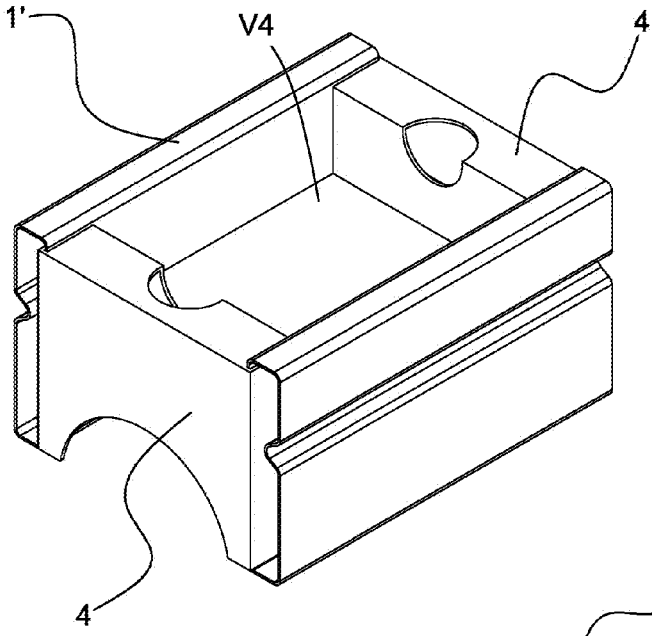
FIG. 19 is a perspective view of a fourth preferred embodiment of paper cushion according to the invention.
Figure 20:
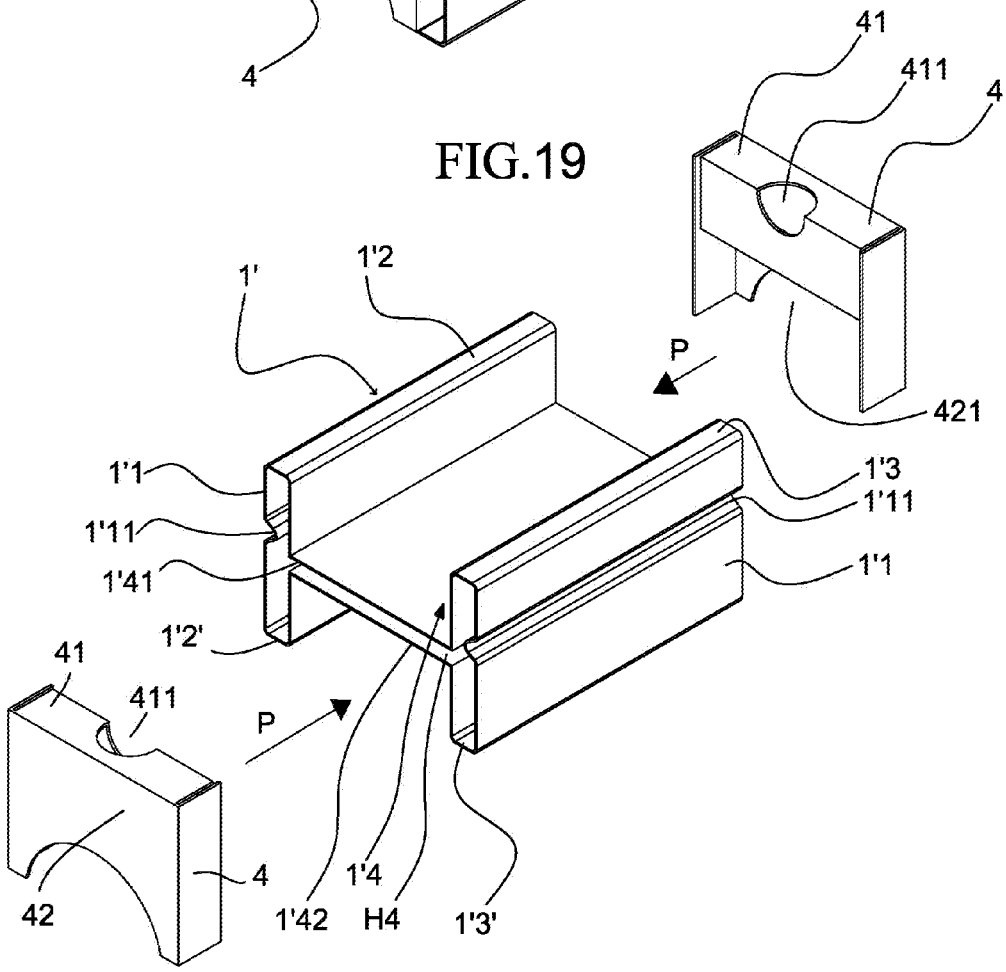
FIG. 20 is an exploded view of the paper cushion in FIG. 19.
Figure 21:
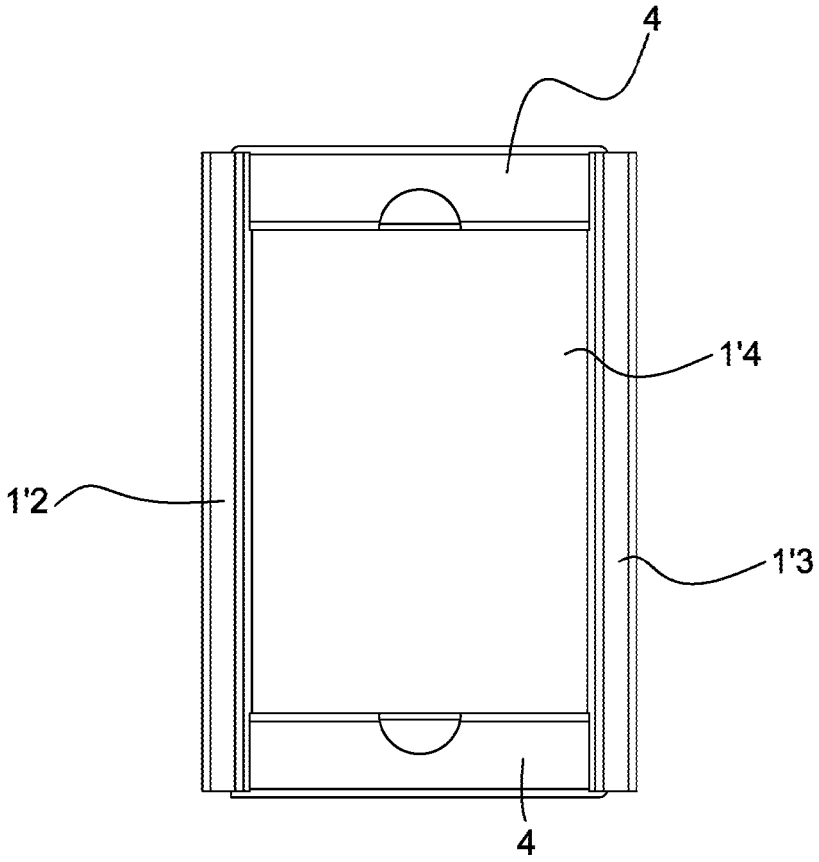
FIG. 21 is a top plan view of the paper cushion in FIG. 19.
Figure 22:
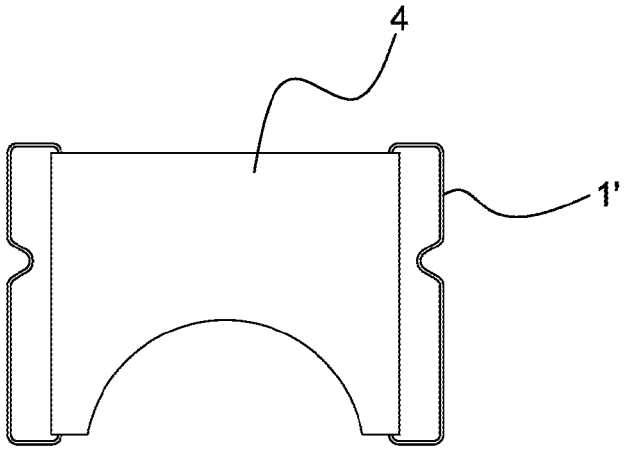
FIG. 22 is a front view of the paper cushion in FIG. 19.
Figure 23:
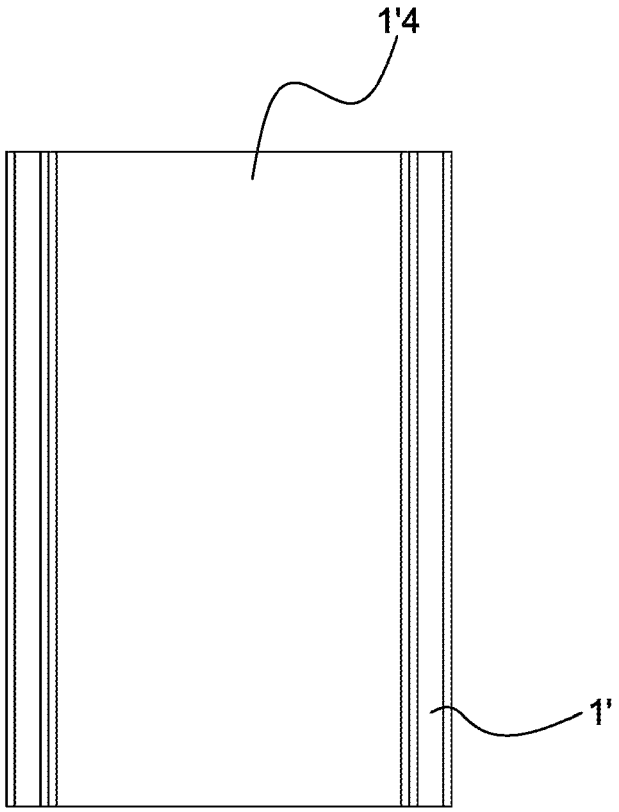
FIG. 23 is a top plan view of the support member in FIG. 20.
Figure 24:
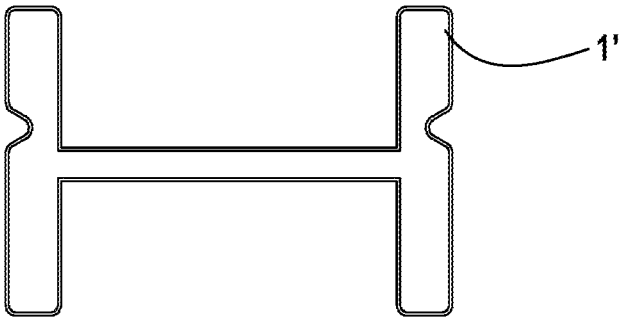
FIG. 24 is a front view of the support member in FIG. 29.

Referring to FIGS. 19 to 24, a paper cushion in accordance with a fourth preferred embodiment of the invention comprises the following components as discussed in detail below.

An elongated, hollow support member 1' of H cross-section has two opposite open ends and comprises two hollow rectangular side walls 11 each comprising a lengthwise elongated trough 111 terminating at both ends. One side wall 11 further comprises a flat top surface 1'2 and a flat bottom surface 1'2' and the other side wall 1'1 further comprises a flat top surface 1'3 and a flat bottom surface 1'3'. The support member 1' further comprises a hollow, rectangular intermediate plate 1'4 interconnecting both side walls 1'1. The intermediate plate 1'4 has a flat top surface 1'41, a flat bottom surface 1'42, and a hollow H4 between the top and bottom surfaces 1'41 and 1'42. The intermediate plate 1'4 has an elevation slightly less than that of the trough 1'11.

Each of two fixing members 4 has a rectangular end surface 42 and two 90-degree bent rectangular sides. The fixing member 4 comprises an inverted L-shaped brace plate 41 extending inward from about top edge of the end surface 42, and a curved cavity 421 on a bottom edge of the end surface 42. Either side of the brace plate 41 is spaced from either side of the fixing member 4 by a distance substantially the same as the thickness of the inner surface of the upper portion of the side wall 1'1. Top of the brace plate 41 is disposed slightly below top of the fixing member 4. A recess 411 is formed on a bending edge of the brace plate 41 distal the end surface 42. Length of the side wall 11 is more than twice of that of the side of the fixing member 4.

In assembly, both sides of each fixing member 4 are inserted into the hollows of the side walls 1'1 from either end as indicated by arrows P to frictionally secure to both ends of the support member 1'. The inner surface of the upper portion of the side wall 1'1 is inserted into the gap between the brace plate 41 and either side of the fixing member 4 and fastened together. The bottom edge of the brace plate 41 is rested upon the intermediate plate 1'4. The tops of the sides of each fixing member 4 are slightly below the top surface of the side wall 1'1. As a result, a paper cushion is assembled and has a packing space V4 having an open top. The packing space V4 is defined by the fixing members 4, the intermediate plate 1'4, and upper portions of the side walls 1'1. An article thus can be packed in the packing space V4 for transport.

Figure 25:
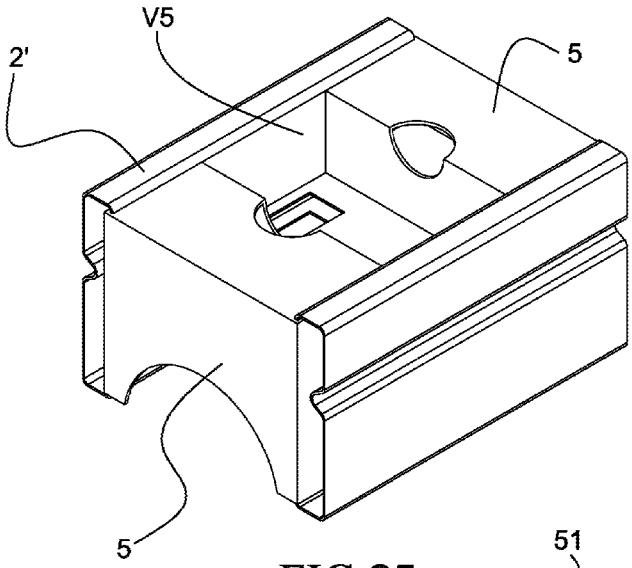
FIG. 25 is a perspective view of a fifth preferred embodiment of paper cushion according to the invention.
Figure 26:
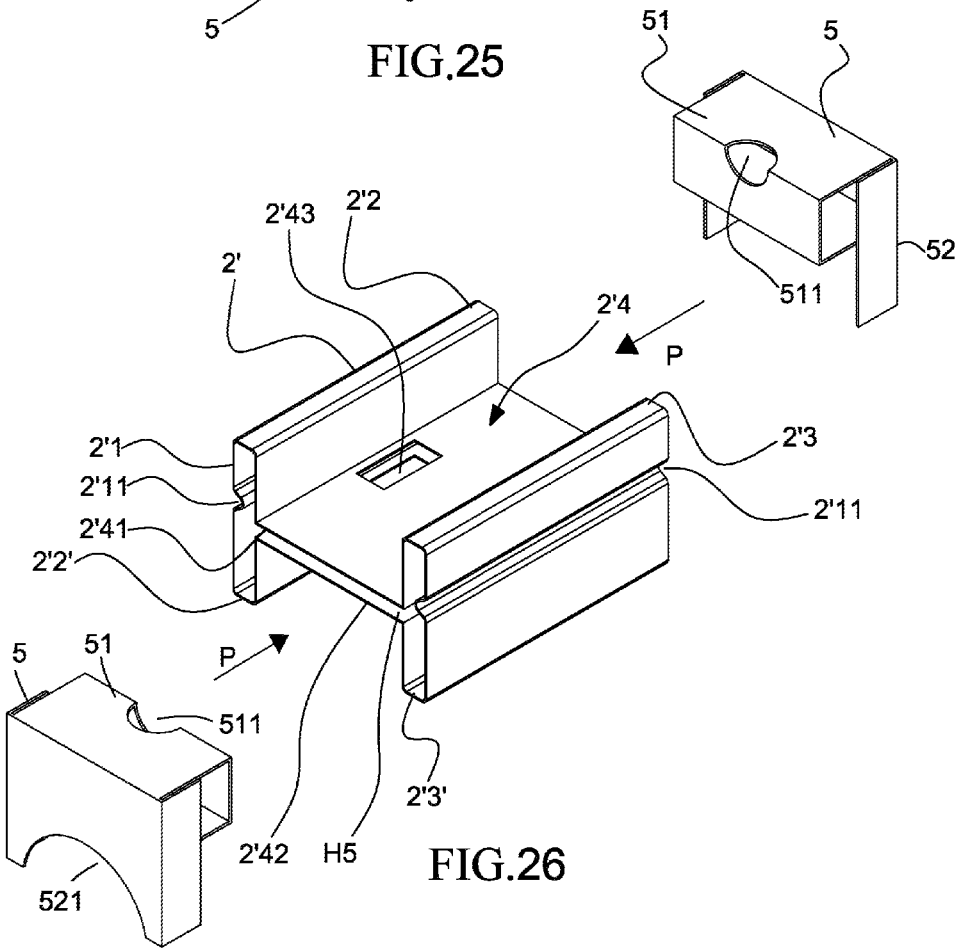
FIG. 26 is an exploded view of the paper cushion in FIG. 25.
Figure 27:
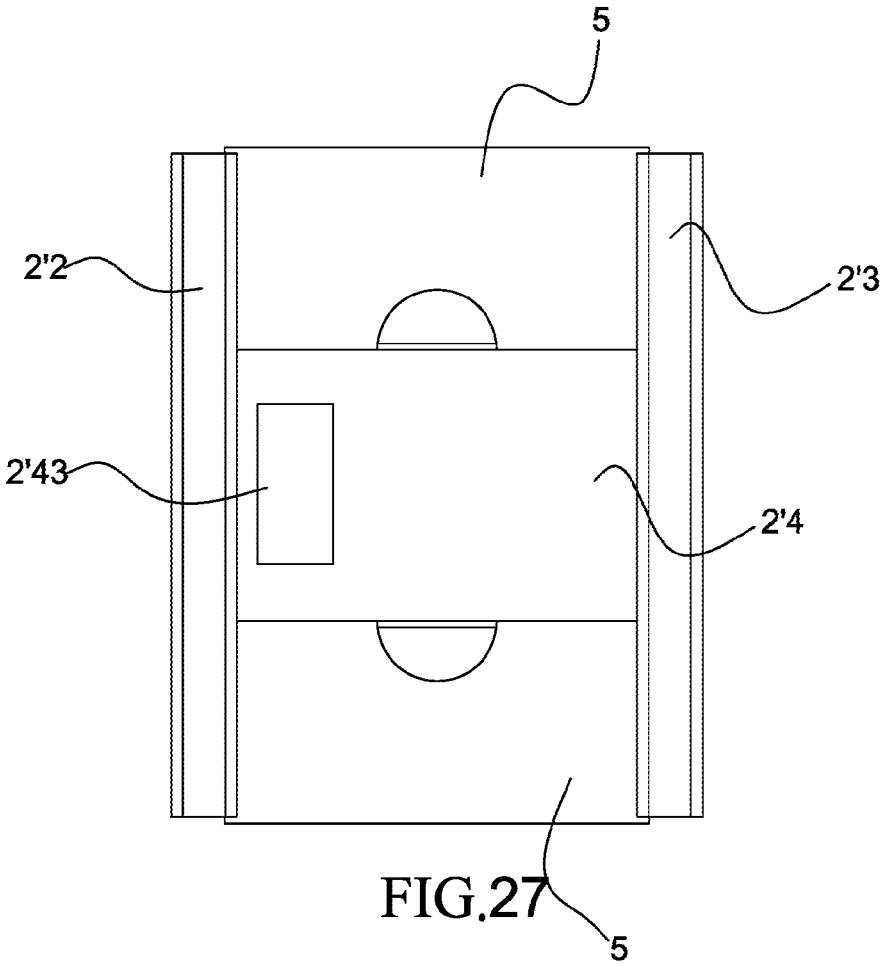
FIG. 27 is a top plan view of the paper cushion in FIG. 25.
Figure 28:
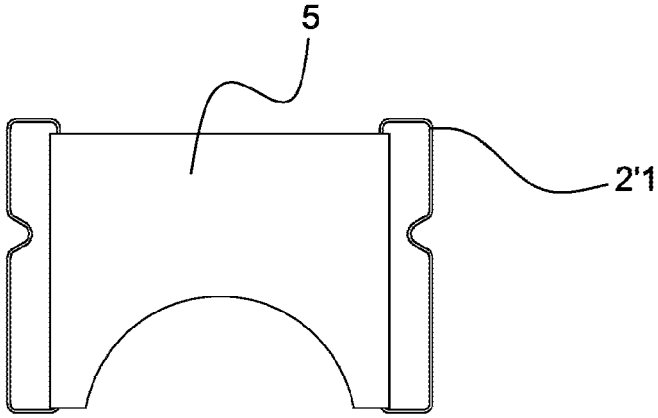
FIG. 28 is a front view of the paper cushion in FIG. 25.
Figure 29:
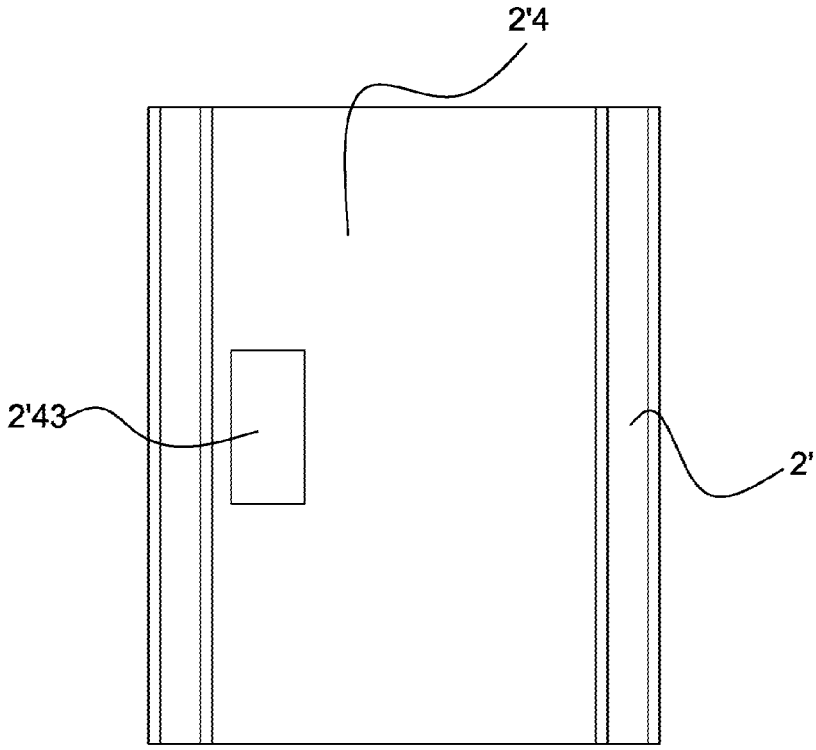
FIG. 29 is a top plan view of the support member in FIG. 26.
Figure 30:
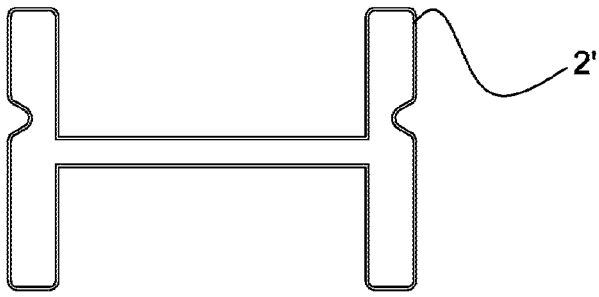
FIG. 30 is a front view of the support member in FIG. 26.

Referring to FIGS. 25 to 30, a paper cushion in accordance with a fifth preferred embodiment of the invention comprises the following components as discussed in detail below.

An elongated, hollow support member 2' of H cross-section has two opposite open ends and comprises two hollow rectangular side walls 2'1 each comprising a lengthwise elongated trough 2'11 terminating at both ends. One side wall 2'1 further comprises a flat top surface 2'2 and a flat bottom surface 2'2' and the other side wall 2'1 further comprises a flat top surface 2'3 and a flat bottom surface 2'3'. The support member 2' further comprises a hollow, rectangular intermediate plate 2'4 interconnecting both side walls 2'1. The intermediate plate 2'4 has a flat top surface 2'41, a flat bottom surface 2'42, a hollow H5 between the top and bottom surfaces 2'41 and 2'42, and a rectangular opening 2'43 through the top surface 2'41, the hollow H5, and the bottom surface 2'42. The intermediate plate 2'4 has an elevation slightly less than that of the trough 2'11.

Each of two fixing members 5 has a rectangular end surface 52 and two 90-degree bent rectangular sides. The fixing member 5 comprises an inverted L-shaped brace plate 51 extending inward from about top edge of the end surface 52, and a curved cavity 521 on a bottom edge of the end surface 52. Either side of the brace plate 51 is spaced from either side of the fixing member 5 by a distance substantially the same as the thickness of the inner surface of the upper portion of the side wall 2'1. Top of the brace plate 51 is disposed slightly below top of the fixing member 5. A recess 511 is formed on a bending edge of the brace plate 51 distal the end surface 52. Length of the side wall 2'1 is more than twice of that of the side of the fixing member 5.

In assembly, both sides of each fixing member 5 are inserted into the hollows of the side walls 2'1 from either end as indicated by arrows P to frictionally secure to both ends of the support member 2'. The inner surface of the upper portion of the side wall 2'1 is inserted into the gap between the brace plate 51 and either side of the fixing member 5 and fastened together. The bottom edge of the brace plate 51 is rested upon the intermediate plate 2'4. The tops of the sides of each fixing member 5 are slightly below the top surface of the side wall 2'1. As a result, a paper cushion is assembled and has a packing space V5 having an open top. The packing space V5 is defined by the fixing members 5, the intermediate plate 2'4, and upper portions of the side walls 2'1. An article thus can be packed in the packing space V4 for transport.

Figure 31:
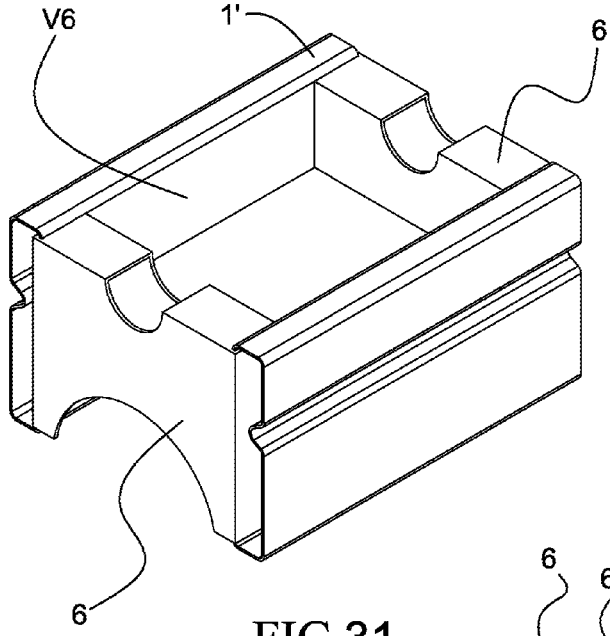
FIG. 31 is a perspective view of a sixth preferred embodiment of paper cushion according to the invention.
Figure 32:
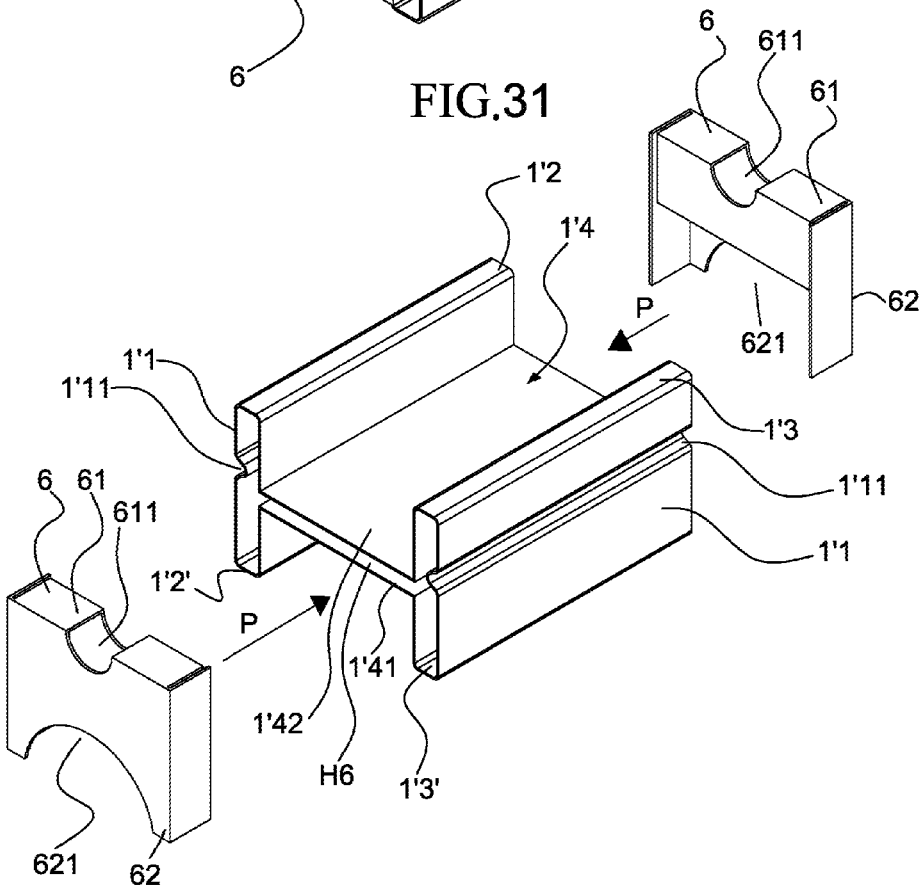
FIG. 32 is an exploded view of the paper cushion in FIG. 31.
Figure 33:
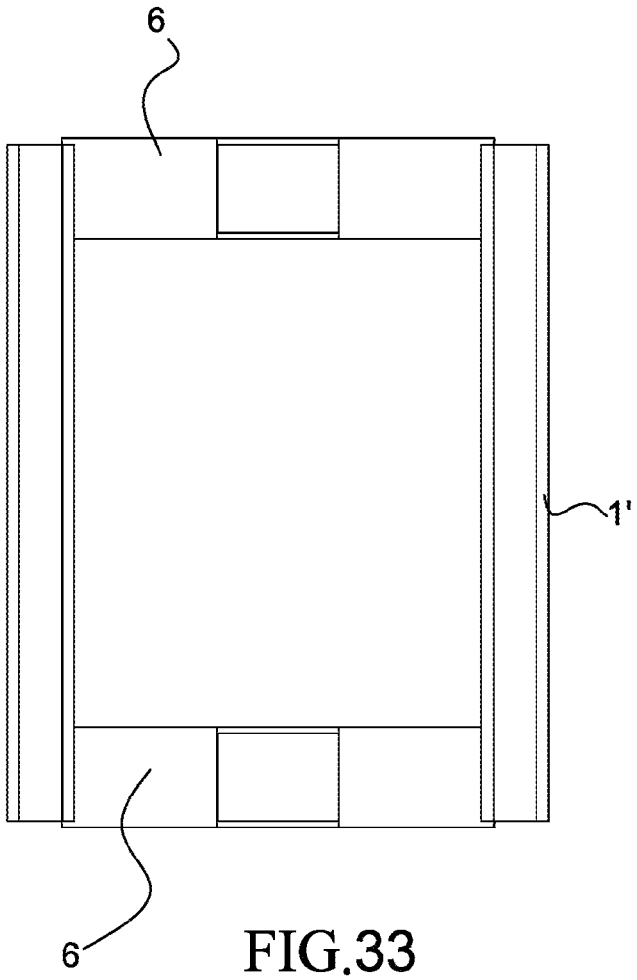
FIG. 33 is a top plan view of the paper cushion in FIG. 31.
Figure 34:
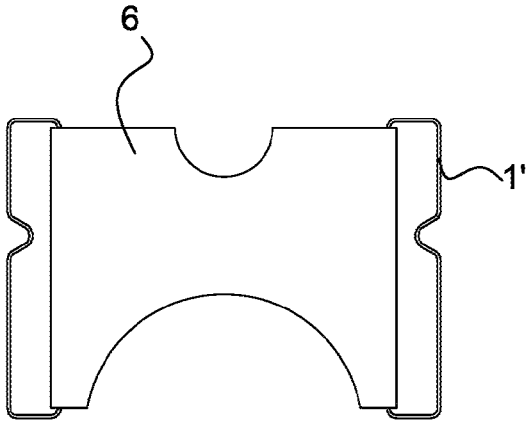
FIG. 34 is a front view of the paper cushion in FIG. 31.
Figure 35:
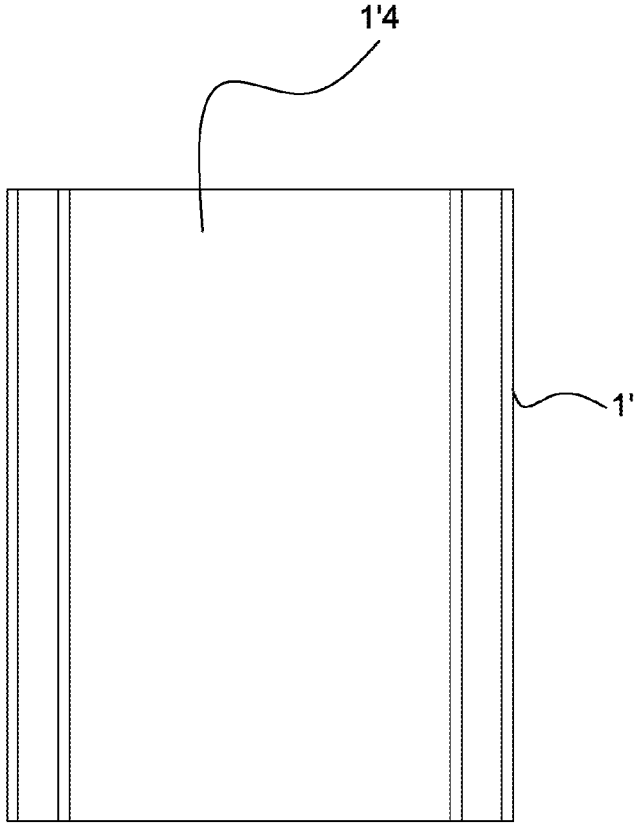
FIG. 35 is a top plan view of the support member in FIG. 32.
Figure 36:
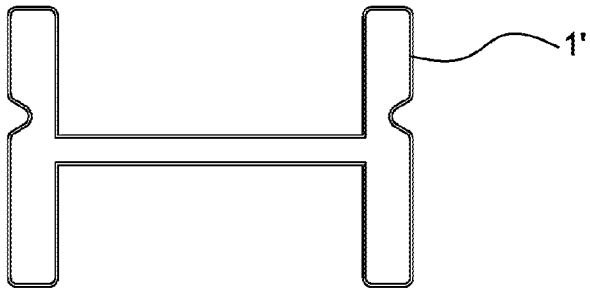
FIG. 36 is a front view of the support member in FIG. 32.

Referring to FIGS. 31 to 36, a paper cushion in accordance with a sixth preferred embodiment of the invention comprises the following components as discussed in detail below.

An elongated, hollow support member 1' of H cross-section has two opposite open ends and comprises two hollow rectangular side walls 11 each comprising a lengthwise elongated trough 111 terminating at both ends. One side wall 11 further comprises a flat top surface 1'2 and a flat bottom surface 1'2' and the other side wall 11 further comprises a flat top surface 1'3 and a flat bottom surface 1'3'. The support member 1' further comprises a hollow, rectangular intermediate plate 1'4 interconnecting both side walls 1'1. The intermediate plate 1'4 has a flat top surface 1'41, a flat bottom surface 1'42, and a hollow H4 between the top and bottom surfaces 1'41 and 1'42. The intermediate plate 1'4 has an elevation slightly less than that of the trough 1'11.

Each of two fixing members 6 has a rectangular end surface 62 and two 90-degree bent rectangular sides. The fixing member 6 comprises an inverted L-shaped brace plate 61 extending inward from about top edge of the end surface 62, a curved well 611 on an intermediate portion of the brace plate 61, and a curved cavity 621 on a bottom edge of the end surface 62. Either side of the brace plate 61 is spaced from either side of the fixing member 6 by a distance substantially the same as the thickness of the inner surface of the upper portion of the side wall 1'1. Top of the brace plate 61 is disposed slightly below top of the fixing member 6. Length of the side wall 1'1 is more than twice of that of the side of the fixing member 6.

In assembly, both sides of each fixing member 6 are inserted into the hollows of the side walls 1'1 from either end as indicated by arrows P to frictionally secure to both ends of the support member 1'. The inner surface of the upper portion of the side wall 1'1 is inserted into the gap between the brace plate 61 and either side of the fixing member 6 and fastened together. The bottom edge of the brace plate 61 is rested upon the intermediate plate 1'4. The tops of the sides of each fixing member 6 are slightly below the top surface of the side wall 1'1. As a result, a paper cushion is assembled and has a packing space V6 having an open top. The packing space V6 is defined by the fixing members 6, the intermediate plate 1'4, and upper portions of the side walls 1'1. An article thus can be packed in the packing space V6 for transport.

While the invention herein disclosed has been described by means of specific embodiments, numerous modifications and variations could be made thereto by those skilled in the art without departing from the scope and spirit of the invention set forth in the claims.

What is claimed is:

1. A paper cushioning structure comprising:

an elongated, corrugated, hollow support member of H cross-section having two open ends, the support member comprising a hollow, intermediate plate interconnecting both sides; and two fixing members disposed at both ends of the support member respectively so as to form a packing space defined by the fixing members, the intermediate plate, and the sides of the support member;

wherein each of the fixing members comprises a rectangular end surface and an inverted L-shaped brace plate extending inward from the top of the end surface, either side of the brace plate being spaced from either side of the fixing member.

2. The paper cushioning structure of claim 1, wherein the brace plate has a bottom edge rested upon the intermediate plate.

* * * * *